US007708358B2

(12) United States Patent
Embacher

(10) Patent No.: US 7,708,358 B2
(45) Date of Patent: May 4, 2010

(54) FURNITURE ITEM HAVING AT LEAST A FIRST AND A SECOND FURNITURE PORTION

(75) Inventor: Thomas Embacher, Lauterach (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 12/213,071

(22) Filed: Jun. 13, 2008

(65) Prior Publication Data

US 2008/0247812 A1 Oct. 9, 2008

Related U.S. Application Data

(63) Continuation of application No. PCT/AT2006/000511, filed on Dec. 12, 2006.

(30) Foreign Application Priority Data

Dec. 15, 2005 (AT) ..... A 2006/2005

(51) Int. Cl.
*A47B 88/00* (2006.01)

(52) U.S. Cl. ..... 312/333

(58) Field of Classification Search ..... 312/334.1, 312/334.4–334.8, 333, 334.44, 334.46, 319.1; 384/20–22

See application file for complete search history.

(56) References Cited

U.S. PATENT DOCUMENTS 3,854,785 A * 12/1974 Manner et al. ..... 312/319.1
4,133,142 A * 1/1979 Dzus, Jr. ..... 49/379
4,159,153 A * 6/1979 Yoshikawa ..... 312/333
5,040,833 A * 8/1991 Brunnert ..... 292/80
5,261,737 A * 11/1993 Faust et al. ..... 312/334.46
5,401,067 A * 3/1995 Kurosaki et al. ..... 292/63
6,669,250 B1 * 12/2003 St. Louis ..... 292/341.11
6,979,065 B2 * 12/2005 Egger ..... 312/333

(Continued)

FOREIGN PATENT DOCUMENTS

DE 20 2004 019 738 4/2005

(Continued)

OTHER PUBLICATIONS

International Search Report issued Mar. 23, 2007 in the International (PCT) Application of which the present application is the U.S. National Stage.

(Continued)

*Primary Examiner*—Janet M Wilkens
(74) *Attorney, Agent, or Firm*—Wenderoth, Lind & Ponack, L.L.P.

(57) ABSTRACT

A piece of furniture having at least a first furniture part and a second furniture part. One furniture past is mounted un a stationary manner, and the other furniture part is mounted in a movable manner, on the basic furniture structure, and can be moved relative to one another. A lockable pushing-out device is arranged on the first furniture part and is intended for moving the movable furniture part from a closed end position into an open position. An engagement element is arranged on the second furniture part and engages with the pushing-out device at least over a part of the opening/closing path (OR/SR) of the movable furniture part. The engagement element is mounted on the second furniture part such that it can be adjusted preferably in linear fashion in relation to the first furniture part.

7 Claims, 4 Drawing Sheets

U.S. PATENT DOCUMENTS

| | | | | |
|---|---|---|---|---|
| 7,229,142 | B2 * | 6/2007 | Lin | 312/333 |
| 2006/0082267 | A1 | 4/2006 | Lin | |
| 2006/0261717 | A1 * | 11/2006 | Chirumbolo | 312/333 |
| 2008/0122333 | A1 * | 5/2008 | Tseng et al. | 312/333 |
| 2008/0191592 | A1 * | 8/2008 | Dubach | 312/319.1 |
| 2008/0218045 | A1 * | 9/2008 | Moser | 312/333 |
| 2008/0246286 | A1 * | 10/2008 | Ostrowski | 292/144 |

FOREIGN PATENT DOCUMENTS

| | | |
|---|---|---|
| DE | 20 2005 002 433 | 6/2005 |
| DE | 20 2005 006 724 | 9/2005 |
| EP | 1 314 842 | 5/2003 |
| GB | 2 174 139 | 10/1986 |

OTHER PUBLICATIONS

Austrian Search Report issued Jan. 15, 2007 in the corresponding Austrian Patent Application (with English translation).

* cited by examiner

FURNITURE ITEM HAVING AT LEAST A FIRST AND A SECOND FURNITURE PORTION

This application is a continuation of International Application No. PCT/AT2006/000511, filed Dec. 12, 2006.

BACKGROUND OF THE INVENTION

The invention concerns a furniture item having at least a first and a second furniture portion, in which one of the furniture portions is stationary and the other furniture portion is mounted movably to the furniture carcass (i.e., the stationary furniture portion) and which are movable relative to each other. A lockable ejection device is arranged on the first' furniture portion for moving the movable furniture portion out of a closed end position into an open position, and an engagement element is arranged on the second furniture portion. At least in a part of the opening/closing path of the movable furniture portion, the engagement element is in engagement with the ejection device.

Furniture items comprising a movable furniture portion and a lockable ejection device for moving the movable furniture portion out of a closed end position into an open position are known per se. In those arrangements, the lockable ejection device permits opening of a handle-less movable furniture portion at least to such an extent that it is possible to grip behind the front panel and open the drawer even without the presence of a handle fitment. In that case, unlocking of the ejection device can be effected for example by way of a button or, in the case of what are referred to as touch-latch fitments, by applying a pressure to the front panel in the closing direction of the movable furniture portion.

In order in that case to be able to adjust the front gap which exists in the closed position of a drawer between the inside of its front panel and the front end faces of the carcass walls of a furniture item, it is further known from DE 20 2004 019 738 U1 for the housing of the opening and closing device which is in the form of a touch-latch mechanism and which is integrated in the extension guide system to be formed to be displaceable in the longitudinal direction and fixable in selectable longitudinal adjusted positions.

SUMMARY OF THE INVENTION

The object of the invention is to provide a furniture item of the general kind described above. In particular, the furniture item on the one hand, permits uncomplicated alteration to the front gap and, on the other hand, has a structurally simple adjustment mechanism.

According to the invention, the above object is attained in that the engagement element is mounted on the second furniture portion preferably linearly displaceably with respect to the first furniture portion.

The fact that, in accordance with the invention, now only the position of the engagement element which can be for example in the form of a hook or pin has to be altered in order to adapt the front gap affords a more stable structure which is easier to adjust in comparison with the state of the art. This is because the opening and closing mechanism which in itself already requires precise adjustment, particularly when it is in the form of a touch-latch mechanism, can remain unchanged.

It is preferably provided in that respect that the first furniture portion is mounted stationary with respect to the furniture item carcass (i.e., the first furniture portion essentially becomes part of the stationary furniture carcass) so that the position of the engagement element (which in this case is arranged on the movable furniture portion) can be easily altered in an open position of the movable furniture portion without the movable furniture portion having to be removed from the carcass of the article of furniture.

It will be appreciated that it is also possible that the second furniture portion with the engagement element is mounted stationarily to the furniture item carcass (so that the second furniture portion becomes part of the carcass). In that case, it should be noted that the engagement element is positioned in such a way that access to the engagement element is possible in an open position of the first furniture portion which in this case is movable.

The position of the engagement element can be particularly easily altered when, in accordance with a further embodiment of the invention, the engagement element is mounted on the second furniture portion adjustably displaceably by a displacement device. It has proven to be desirable if the displacement device has a housing which is arranged on the second furniture portion, and the engagement element is mounted movably in the opening/closing direction of the movable furniture portion. By virtue of the arrangement of the engagement element in a housing, the housing serves as it were as a guide for the engagement element. Thus, a change in position of the engagement element with respect to the first furniture portion can be effected without manipulation on the second furniture portion.

In accordance with a preferred embodiment of the invention, it is provided in that respect that the preferably self-locking displacement device is formed to convert a rotary movement into a translatory movement. A rotatably mounted actuating element which has a spiral-shaped sliding guide is operatively connected to the linearly movable engagement element. For simple access to the engagement element, it has proven desirable if the axis of rotation of the actuating element includes a substantially right angle with the direction of movement of the engagement element. That, on the one hand, permits comfortable operation of the displacement device and, on the other hand, ensures stepless longitudinal displacement of the engagement element which, if it is of a self-locking nature, remains in any position once set, without further assistance. Although it would be basically conceivable for the lockable ejection device to be released by means of a separate touch device or pushbutton, a preferred, particularly user-friendly embodiment of the invention provides that the lockable ejection device is in the form of a touch-latch mechanism.

In that respect, in accordance with a structurally particularly simple solution, it is provided that the lockable ejection device is arranged in a housing and has a receiving element which is mounted movably in the housing. The lockable ejection device is adapted for engagement with the engagement element arranged on the second furniture portion. It has proven to be desirable if the direction of movement of the movable receiving element in the housing includes an angle of greater than zero, preferably between 2° and 15°, with the opening/closing direction of the movable furniture portion.

In other words, the receiving element of the lockable ejection device is guided in a straight guide path extending at an incline. At one end of the guide path it is in engagement with the engagement element, while at the other opposite end it is out of engagement with the engagement element. In that way, curved or heart-shaped guide slides as are known from the state of the art and which entail an elevated rate of material wear can be avoided.

BRIEF DESCRIPTION OF THE DRAWINGS

Further details and advantages of the present invention will be described more fully on the basis of the specific description with reference to the embodiments by way of example illustrated in the drawings in which.

DETAILED DESCRIPTION OF THE INVENTION

Figure 1A:
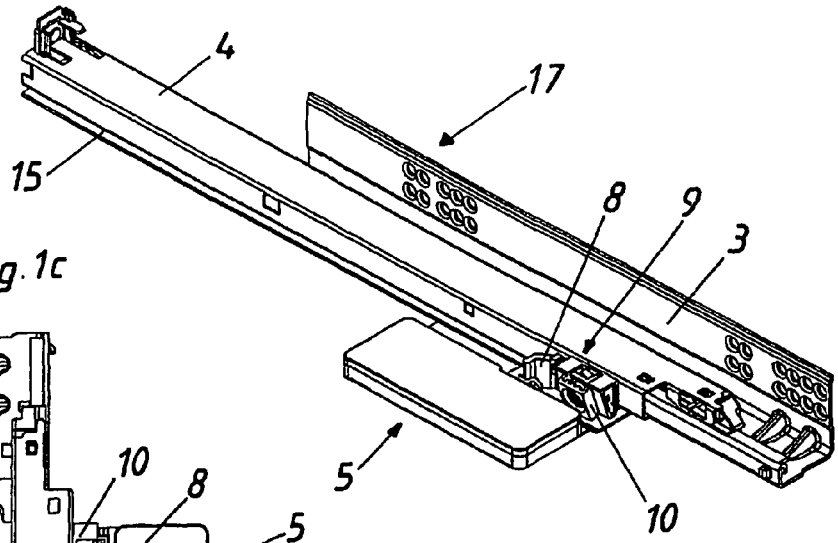
FIGS. 1*a* through 1*c* show an oblique view from above, an oblique view from below, and a plan view of a first and a second furniture portion which are movable relative to each other.
Figure 1C:
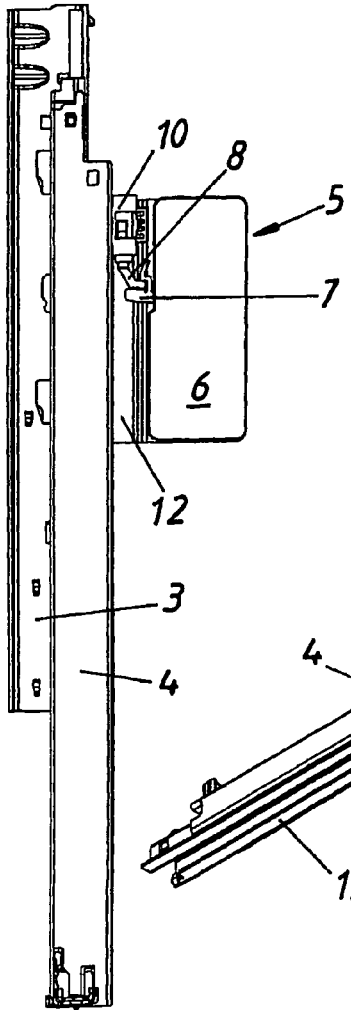
Figure 1B:
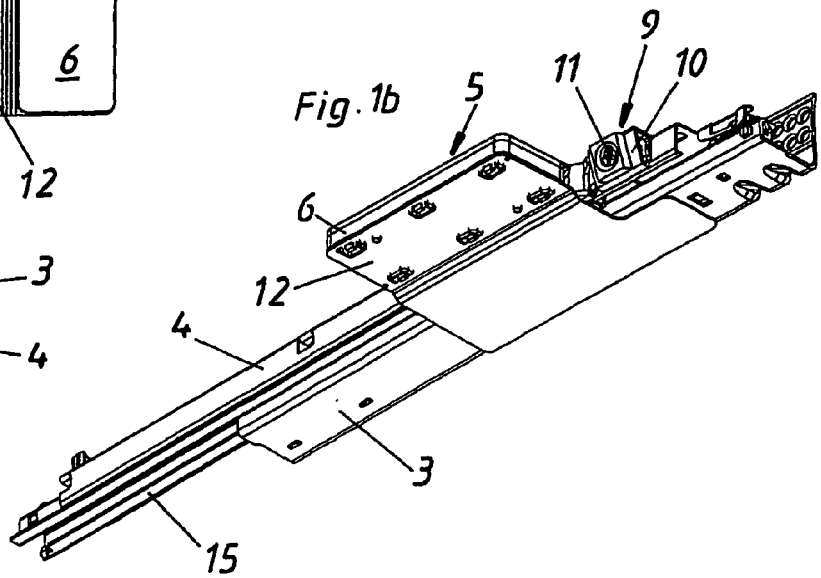

FIGS. 1*a* through 1*c* show an extension guide 17 for a drawer, which includes a first furniture portion 3 in the form of a carcass rail, a second furniture portion 4 in the form of a drawer rail, and a intermediate rail 15 disposed between the first furniture portion 3 and the second furniture portion 4. The extension guide 17 is mounted to the carcass of furniture item (not shown) in a stationary manner by way of the first furniture portion 3. A housing 6 of a lockable ejection device 5 is fixed to the first furniture portion 3 by way of a mounting plate 12 (FIG. 1*b*). Arranged on the second furniture portion 4 which is movable relative to the first furniture portion 3 is an engagement element 8 which is adapted to engage with a receiving element 7 (FIG. 1*c*) of the lockable ejection device 5 in such a way that the engagement element 8 is linearly adjustably displaceable in the housing 10 of a displacement device 9, more specifically by way of the actuating element 11.

Figure 2A:
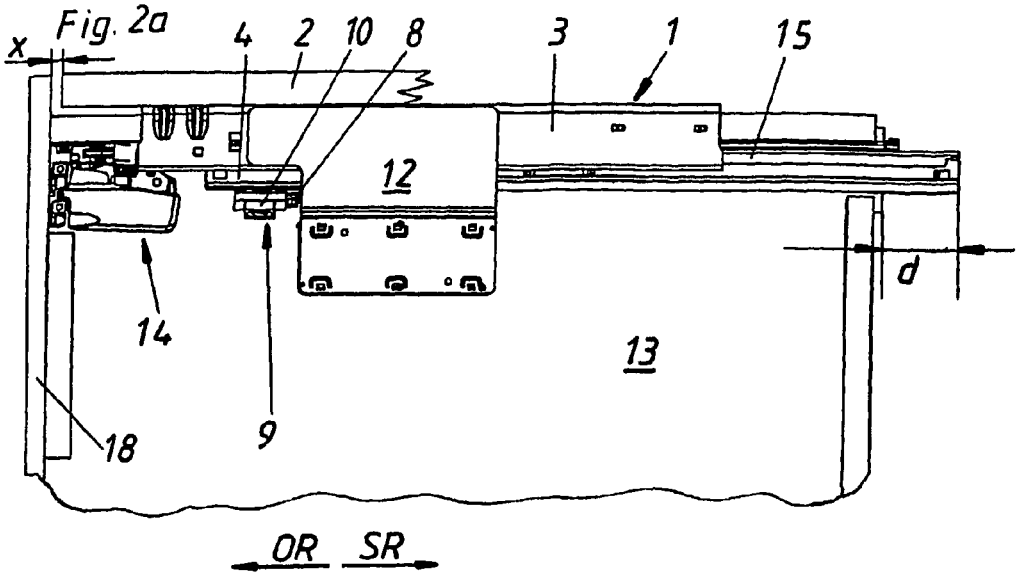
FIGS. 2*a* and 2*b* show a view from below of a part of a furniture item with a drawer in two different positions.
Figure 2B:
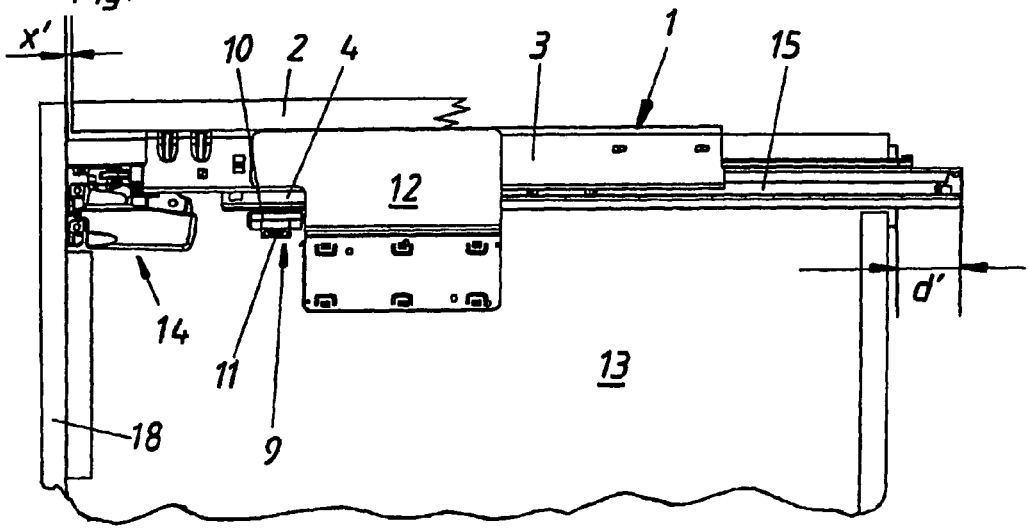

The linear displaceability of the engagement element 8 serves to be able to adjust the front gap between the front panel 18 of the drawer 13 and the furniture carcass 2, as is shown in FIGS. 2*a* and 2*b*.

It will be seen from FIG. 2*a* that the drawer 13 with its front panel 18 is fixed to the second movable furniture portion 4 by way of a fixing device 14. In the illustrated embodiment, the second movable furniture portion 4 forms the drawer rail on which the engagement element 8 is mounted linearly movably in the housing 10 of the displacement device 9. The second movable furniture portion 4 is connected to the first furniture portion 3 so as to be movable relative thereto, with the interposition of the intermediate rail 15. In the illustrated embodiment, the first furniture portion 3 is formed by the carcass rail arranged stationarily on the carcass 2 of the furniture item 1. The lockable ejection device 5 is fixed to the first furniture portion 3 by means of the mounting plate 12.

Figure 3:
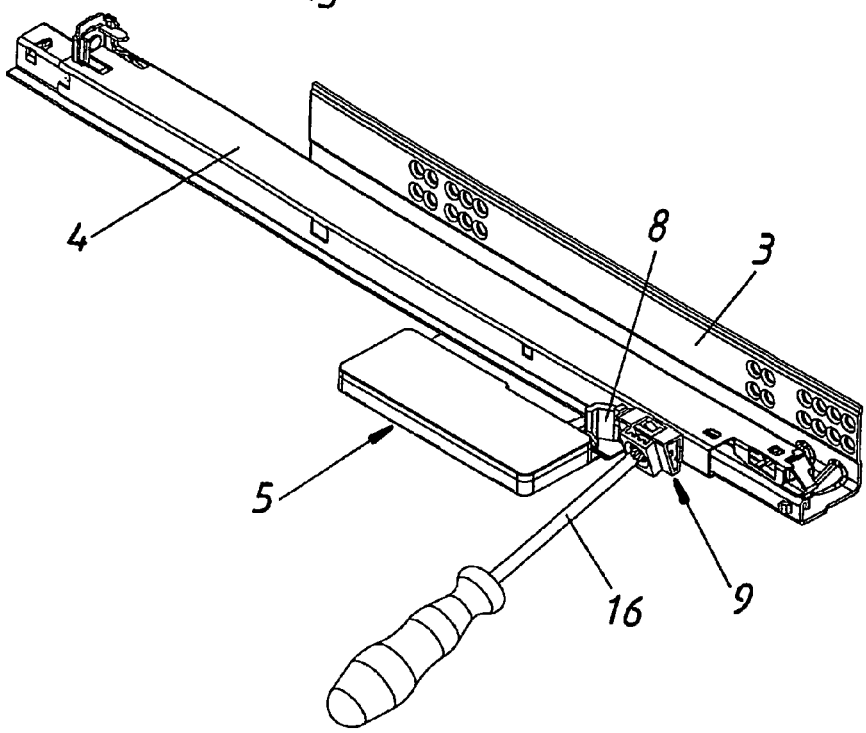
FIG. 3 shows the embodiment of FIG. 1 with a tool for displacement of the engagement element.
Figure 4:
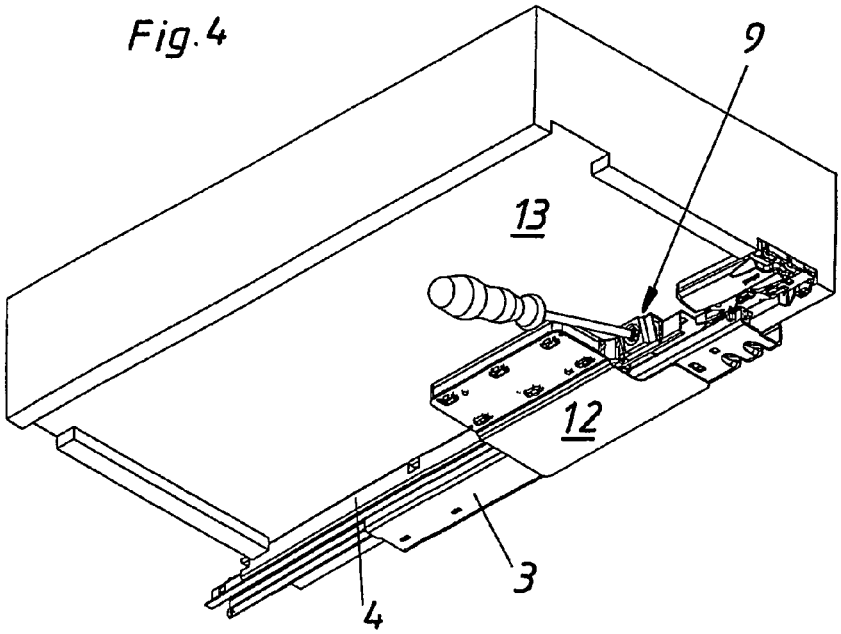
FIG. 4 shows an oblique view from below of the embodiment of FIG. 3 with the drawer fixed.

In order to alter the front gap, as shown in FIGS. 3 and 4, the actuating element 11 of the displacement device 9 is actuated by a suitable tool 16, in this case a screwdriver, whereby the position of the engagement element 8 is altered in the opening/closing direction OR. Starting from the position shown in FIG. 2*a*, the actuating element 11 of the displacement device is rotated towards the left whereby the engagement element 8 is also moved linearly towards the left, that is to say further into the housing 10 of the displacement device 9 (FIG. 2*b*). That linear displacement of the engagement element 8 also alters the relative position of the second movable furniture portion 4 with respect to the first stationary furniture portion 3—upon engagement of the engagement element 8 with the receiving element 7 of the lockable ejection device—so that the front gap x' shown in FIG. 2*b* is smaller by the magnitude of the linear movement of the engagement element 8, than the front gap x shown in FIG. 2*a*. The spacing d of the rear end of the drawer 13 from the rear end of the intermediate rail 15 is shortened by the same amount to the spacing d' shown in FIG. 2*b*.

Figure 5A:
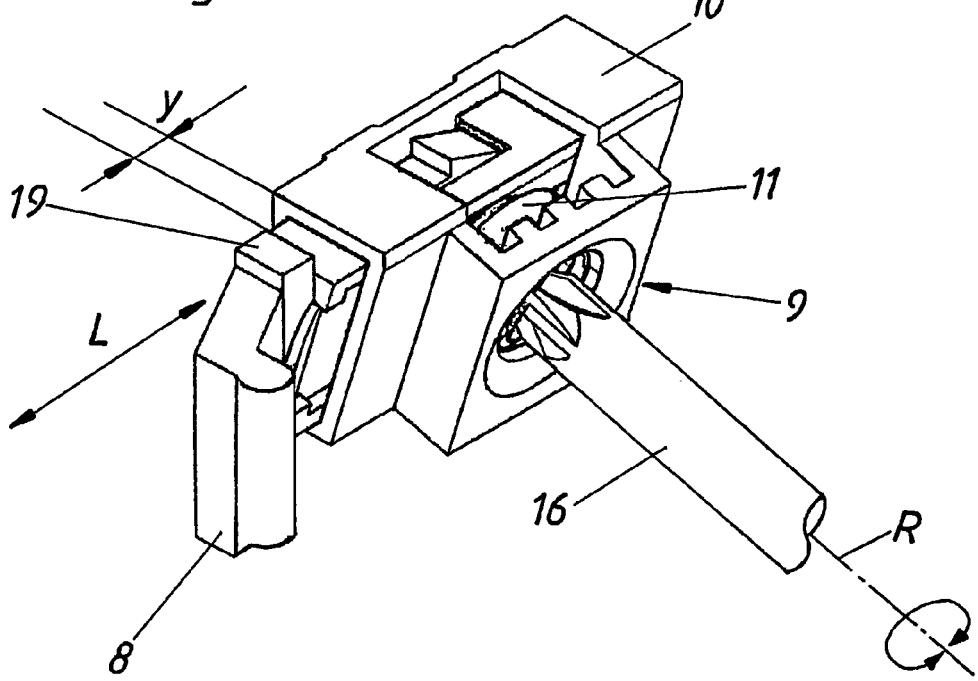
FIGS. 5*a* and 5*b* show the displacement device for the engagement element in two different positions of the engagement element.
Figure 5B:
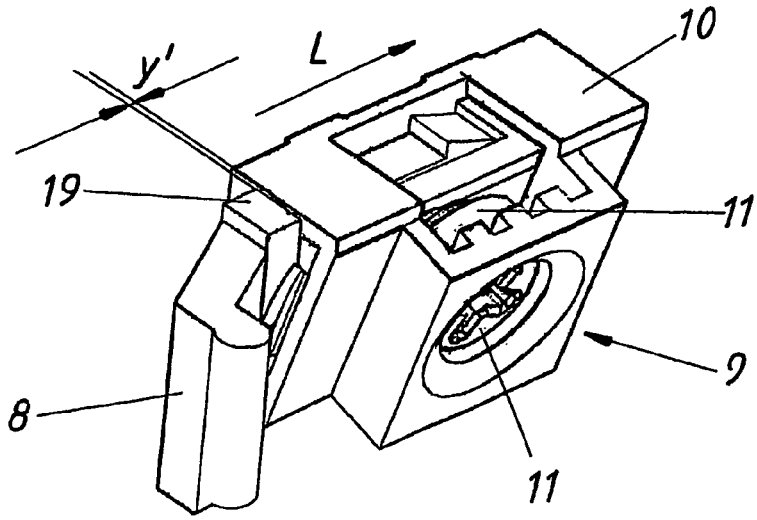

FIGS. 5*a* and 5*b* show in detail the displacement device 9 in two different positions of the engagement element 8. In this case, the engagement element 8 is mounted in the housing 10 linearly movably in the direction of movement L and is operatively connected to the actuating element 11 rotatable about its axis of rotation R. On its side towards the engagement element 8, the actuating element 11 has a spiral-shaped sliding guide which engages into a tooth arrangement on the engagement element 8. That arrangement provides that a rotary movement of the actuating element 11 about its axis of rotation R is converted into a translatory movement of the engagement element 8 in the direction of movement L, with the axis of rotation R including a substantially right angle with the direction of movement L in the illustrated embodiment. On its side opposite the spiral-shaped sliding guide, the actuating element 11 is adapted for engagement with a tool 16.

If now, starting from the position shown in FIG. 5*a*, the actuating element 11 is rotated about its axis of rotation R by means of the tool 16, the engagement element 8 moves towards the right further into the housing 10 of the displacement device 9. Thus, the spacing y between the abutment 19 of the engagement element 8 and the housing 10 (FIG. 5*a*) decreases to the spacing y' shown in FIG. 5*b*. In that respect, the amount by which the spacing between the abutment 19 and the housing 10 changes corresponds to the amount by which the front gap between the front panel 18 and the carcass 2 of the article of furniture changes.

Arranging the actuating element 11 of the displacement device 9 in a plane extending at an incline relative to the plane of the engagement element 8 has the advantage that the tooth arrangement on the engagement element 8 cannot leave the spiral-shaped sliding guide on the actuating element 11. Thus, a longer displacement travel for the engagement element 8 in the direction of movement L can be achieved.

The illustrated embodiments of depthwise displacement of a movable furniture portion in relation to the carcass of the furniture item for adjustment of the front gap are obviously not to be interpreted in a restrictive sense, but only as individual examples of numerous possible ways of carrying the concept of the invention of a furniture item with an adjustment mechanism for the front gap into effect.

The invention claimed is:

1. A furniture item comprising:

a first furniture portion;

a second furniture portion, one of said first furniture portion and said second furniture portion comprising a stationary furniture portion to be mounted in a stationary manner to a furniture carcass, and the other of said first furniture portion and said second furniture portion comprising a movable furniture portion mounted so as to be movable relative to the furniture carcass, said first furniture portion and said second furniture portion being movable relative to each other;

a lockable ejection device on said first furniture portion for moving said movable furniture portion from a closed end position to an open position;

an engagement element on said second furniture portion so as to be adjustably movable relative to said first furniture portion, said engagement element being located such that, when said engagement element is located along at least a part of an opening/closing path of said movable furniture portion, said engagement element is engaged with said ejection device; and a displacement device for adjustably moving said engagement element relative to said first furniture portion, said displacement device including a rotatable actuating element having a spiral-shaped sliding guide, and said displacement, device being operable to convert a rotary movement of said actuating element into a linear movement of said engagement element.

2. The furniture item of claim 1, wherein said second furniture portion is mounted to said first furniture portion so as to be linearly movable with respect to said first furniture portion.

3. The furniture item of claim 1, wherein said displacement device has a housing arranged on said second furniture portion, said engagement element being mounted in said housing so as to be movable along the opening/closing path of said movable furniture portion.

4. The furniture item of claim 1, wherein an axis of rotation of said actuating element is oriented at a substantially right angle with respect to a path of movement of said engagement element.

5. The furniture item of claim 1, wherein said lockable ejection device is arranged in a housing and has a receiving element movably mounted in said housing, said receiving element being operable to engage said engagement element on said second furniture portion.

6. The furniture item of claim 5, wherein a path of movement of said movable receiving element in said housing forms an angle greater than zero with said opening/closing path of said movable furniture portion.

7. The furniture item of claim 5, wherein a path of movement of said movable receiving element in said housing forms an angle in a range between 2° and 15° with said opening/closing path of said movable furniture portion.

* * * * *